US008368552B2

(12) United States Patent
Miller, II et al.

(10) Patent No.: US 8,368,552 B2
(45) Date of Patent: Feb. 5, 2013

(54) MANHOLE SECURITY DEVICE AND METHODS THEREOF

(75) Inventors: Robert R. Miller, II, Convent Station, NJ (US); Edward G. Amoroso, Andover, NJ (US); Susan R. Bailey, Randolph, NJ (US); Lusheng Ji, Randolph, NJ (US); Harry R. Worstell, Florham Park, NJ (US); David M. Britz, Rumson, NJ (US)

(73) Assignee: AT&T Intellectual Property I, L.P., Atlanta, GA (US)

( * ) Notice: Subject to any disclaimer, the term of this patent is extended or adjusted under 35 U.S.C. 154(b) by 489 days.

(21) Appl. No.: 12/645,023

(22) Filed: Dec. 22, 2009

(65) Prior Publication Data

US 2011/0148647 A1 Jun. 23, 2011

(51) Int. Cl.
*G08B 21/00* (2006.01)
*E02D 29/14* (2006.01)

(52) U.S. Cl. ..... 340/686.1; 340/870.16; 404/25

(58) Field of Classification Search ..... 340/635, 340/636.12, 636.15, 657, 660, 661, 686.1, 340/870.01, 870.02, 870.31, 612, 618, 870.16; 324/500, 501; 105/377.07, 358, 286; 404/25, 404/72, 83

See application file for complete search history.

(56) References Cited

U.S. PATENT DOCUMENTS

| | | | | |
|---|---|---|---|---|
| 5,583,492 | A * | 12/1996 | Nakanishi et al. | 340/870.02 |
| 6,550,294 | B2 | 4/2003 | Garguilo | |
| 6,739,796 | B1 | 5/2004 | Del Nero et al. | |
| 7,002,481 | B1 * | 2/2006 | Crane et al. | 340/618 |
| 7,055,440 | B2 * | 6/2006 | Sisk | 105/286 |
| 7,342,504 | B2 * | 3/2008 | Crane et al. | 340/612 |
| 7,467,049 | B2 * | 12/2008 | Hayes et al. | 702/60 |
| 7,944,365 | B2 * | 5/2011 | Walters et al. | 340/660 |
| 2009/0324328 | A1 * | 12/2009 | Roberts | 404/25 |
| 2010/0039339 | A1 * | 2/2010 | Kuroda et al. | 343/755 |

* cited by examiner

*Primary Examiner* — Van T. Trieu
(74) *Attorney, Agent, or Firm* — Akerman Senterfitt; Michael K. Dixon; Roy Zachariah

(57) ABSTRACT

A security device for detecting the position of a manhole cover includes a pinger device, such as an acoustic pinger, that transmits a signal in the direction of the expected position of the manhole cover. The device takes energy samples to determine if the signal has been reflected back by the manhole cover. If the device determines the signal has not been reflected, it determines that the manhole cover has been moved from the expected position. In response, the device captures an image of an area around the expected position of the manhole cover. In addition, the device can notify a remote security station via a network that the manhole cover has been moved.

20 Claims, 5 Drawing Sheets

MANHOLE SECURITY DEVICE AND METHODS THEREOF

FIELD OF THE DISCLOSURE

The present disclosure generally relates to security devices and more particularly to security devices for manholes.

BACKGROUND

Electrical cabling is employed for a wide variety of purposes. For example, fiber optic cabling is often employed in communications networks, providing a physical medium for communication of voice or data information. Electrical cabling is also used to distribute power from central power stations to substations and ultimately to end users. In order to protect cabling from environmental conditions, the cabling is sometimes buried underground, with small enclosures arrayed along the length of the cabling. These enclosures are typically accessible via a surface aperture, with the aperture itself being protected with a manhole cover.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF THE DRAWINGS

The numerous innovative teachings of the present application will be described with particular reference to the presently preferred exemplary embodiments. However, it should be understood that this class of embodiments provides only a few examples of the many advantageous uses of the innovative teachings herein. In general, statements made in the specification of the present application do not necessarily limit any of the various claimed inventions. Moreover, some statements may apply to some inventive features but not to others.

Figure 1:
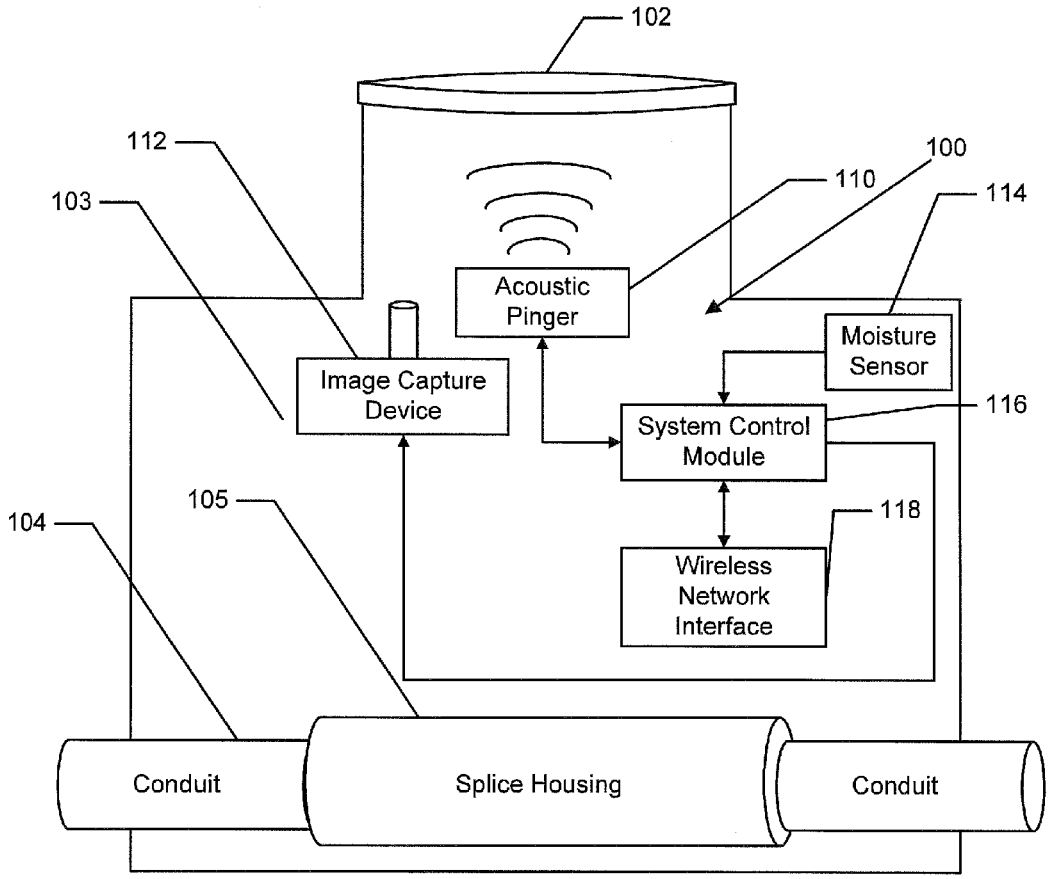
FIG. 1 is a block diagram of a manhole security device in accordance with one embodiment of the present disclosure.

FIG. 1 shows a manhole security device 100 in accordance with one embodiment of the present disclosure, together with a particular example of an environment surrounding the security device. In particular, FIG. 1 illustrates a manhole cover 102 that provides access to an enclosure 103. The enclosure 103 contains a conduit 104 having a splice housing 105. The conduit 104 contains electrical cabling (not shown), such as fiber optic cables, power cables, telephone cables, or the like, or any combination thereof.

In an embodiment, the enclosure 103 is a subterranean enclosure sufficiently large to allow one or more individuals to access the splice housing 105. Further, the splice housing 105 is a removable assembly that provides access to the electrical cabling enclosed within the conduit. Thus, an individual can access the electrical cabling by removing the manhole cover 102, entering the enclosure 103 and removing the splice housing 105. The individual can then repair or replace a portion of the electrical cabling. The manhole security device 100 is configured to record when the manhole cover 102 is removed, thereby providing an indication that the electrical cabling is likely to be accessed.

In particular, the manhole security device 100 includes an acoustic pinger 110, an image capture device 112, a moisture sensor 114, and a wireless network interface 118, each of which is connected to a system control module 116. The system control module 116 includes one or more data processing devices, such as general purpose or application specific processors, configured to control the operations of the manhole security device 100, as described further herein.

The acoustic pinger 110 is configured to periodically transmit an acoustic signal via an acoustic output. Further, in response to transmitting the acoustic signal, the acoustic pinger 110 takes one or more acoustic samples at an acoustic sensor of the pinger. In an embodiment, the acoustic samples are taken at a time at which the previously transmitted acoustic signal is expected to be reflected back to the transducer. If the acoustic samples indicate that the acoustic signal has not been reflected back, the acoustic pinger 110 provides an indication to the system control module 116.

The image capture device 112 is configured to capture one or more images in response to a command from the system control module 116. The image capture device 112 can also provide an illumination source, to ensure that a captured image is of a desired resolution and quality. In an embodiment, the image capture device 112 is a digital camera device that is configured to store digital picture information in response to the command from the system control module 116. In addition, the image capture device 112 can communicate the digital picture information to the system control module 116 in response to a request. In a particular embodiment, the image capture device 112 can record images from outside the visible light spectrum. For example, the image capture device 112 can be an infra-red camera, an ultra-violet camera, or the like. In addition, the image capture device 112 can be configured to withstand environmental conditions of the enclosure 103. For example, in one embodiment a lens of the image capture device 112 is composed of a hydrophobic material, so that water is less likely to collect on the lens. In other embodiments, a hydrophobic film can be placed over the lens.

The moisture sensor 114 is configured to determine a moisture level surrounding the manhole security device 100, and provide an indication of the moisture level to the system control module 116. In an embodiment, the moisture sensor 114 includes one or more pressure sensors that provide an indication of moisture level based on the environmental pressure surrounding the manhole security device 100. In another embodiment, the moisture sensor 114 is an electronic switch configured to switch from one state, such as an open state, to another state, such as a closed state, based on the presence of a threshold amount of moisture surrounding the manhole security device 100. Accordingly, in this embodiment, the moisture sensor 114 provides a binary indication of whether the amount of moisture surrounding the manhole security device 100 exceeds a threshold level.

The wireless network interface 118 provides an interface between the system control module 116 and a communications network (not shown). In an embodiment, the wireless network interface 118 provides an interface to a wide area network, such as a network that complies with the International Mobile Telecommunications-2000 (IMT-2000) standards.

In operation, the acoustic pinger 110 is arranged so that it periodically transmits its acoustic signal in the direction of the manhole cover 102. Accordingly, as long as the manhole cover 102 is in an expected position, such as a closed position, the acoustic signal will be reflected back to the acoustic pinger 110 in an expected amount of time. The reflected acoustic signal is detected by the acoustic sensor at the acoustic pinger 110, which can provide an indication to the system control module 116 that the expected acoustic signal has been detected.

If the manhole cover is moved more than a defined amount, the expected acoustic signal will not be reflected back to the acoustic pinger 110. Accordingly, based on the samples taken at the acoustic sensor, the acoustic pinger 110 can determine that the manhole cover 102 has been moved. In response, the acoustic pinger 110 notifies the system control module 116.

In response to receiving the notification that the manhole cover 102 has been moved, the system control module 116 instructs the image capture device 112 to capture one or more images. In a particular embodiment, the image capture device 112 is arranged so that it captures an image of the area surrounding the manhole cover 102. Accordingly, in response to an indication from the acoustic pinger 110 that the manhole cover 102 has been moved from its expected position, the image capture device 112 captures one or more images of the area around the cover.

In addition, in response to an indication from the acoustic pinger 110 that the manhole cover 102 has been moved the system control module 116 can provide a notification to a remote location via the wireless network interface 118. The system control module 116 can provide additional information, such as the time and date that the indication from the acoustic pinger was received, the geographic location of the manhole security device 100, or the like, and can also provide any captured images from the image capture device 112.

The operation of the manhole security device 100 can be better understood with reference to an example. In this example, it is assumed that the expected position of the manhole cover 102 is a closed position, such that the enclosure 103 cannot be accessed. In the event that the manhole cover 102 is moved from the closed position, the acoustic pinger provides an indication to the system control module 116 of the movement. In response, the system control module 116 instructs the image capture device 112 to capture one or more images, thereby recording a visual representation of the individual or individuals responsible for moving the manhole cover 102. Further, the system control module 116 provides an indication that the manhole cover 102 has been moved to a remote security station via the wireless network interface 118. Security officers at the security station can then take appropriate action, such as determining whether the movement of the manhole cover 102 represents an authorized or unauthorized access of the enclosure 112. In the event of an unauthorized access, the security officers can notify law enforcement or other security personnel. Further, the security officers can request the system control module 116 to transmit any captured images from the image capture device 112 to the remote security station via the wireless network interface 318.

The moisture sensor 114 provides an indication of whether the moisture level 114 exceeds a threshold amount. The indication can be used to determine whether to place the manhole security device 100 in a suspended mode, so that it does not attempt to detect whether the manhole cover 102 has been moved. For example, during a period of extended rain, the enclosure 103 can fill with water, such that the acoustic pinger 110 can no longer reliably transmit or sample acoustic signals. Accordingly, in response to an indication from the moisture sensor 114 that the water level surrounding the manhole security device 100 exceeds a threshold level, the system control module 116 can place the device in a suspended mode, such that it does not periodically transmit or sample the acoustic signal. This reduces the likelihood of a false indication that the manhole cover 102 has been moved, as well as reducing power consumption.

It will be appreciated that one or more modules of the manhole security device 100 can be altered without departing from the scope of this disclosure. For example, in an embodiment the manhole security device 100 can employ a photonic pinger that transmits and samples a light-based signal, such as a laser, to determine whether the manhole cover 102 has been moved. In another embodiment, the manhole security device can employ an electromagnetic sensor that determines whether the manhole cover 102 has been moved based on changes in an electromagnetic field generated by the pinger. In another embodiment, the manhole security device 100 can employ multiple acoustic pingers, multiple photonic pingers, electromagnetic or a combination thereof, and determine whether the manhole cover 102 has been moved based on information provided by any combination of the pingers.

Figure 2:
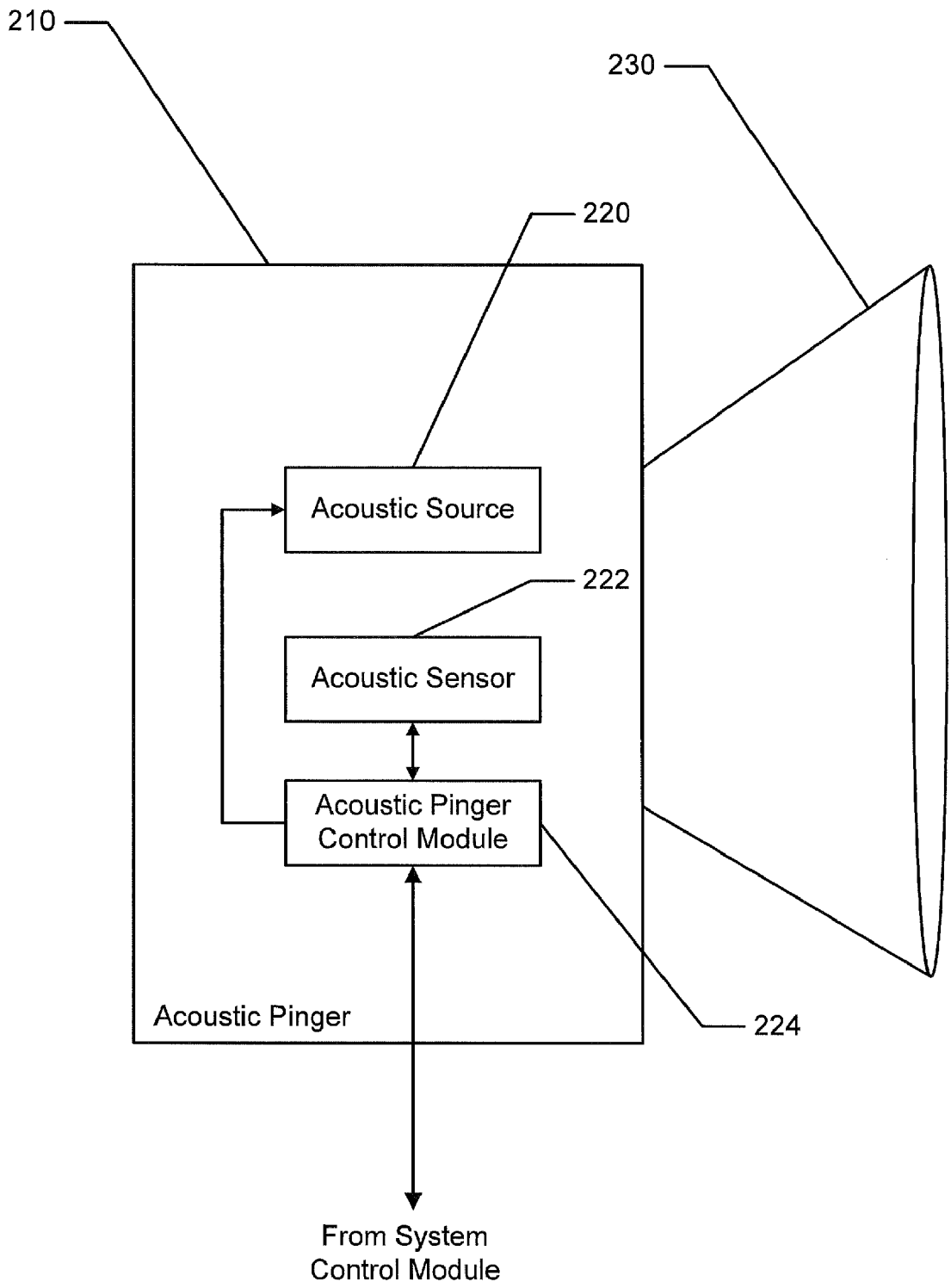
FIG. 2 is a block diagram of an acoustic pinger of the manhole security device of FIG. 1 in accordance with one embodiment of the present disclosure.

FIG. 2 illustrates a block diagram of a particular embodiment of an acoustic pinger 210, corresponding to the acoustic pinger 110 of FIG. 1. The acoustic pinger 210 includes an acoustic source 220, an acoustic sensor 222, an acoustic pinger control module 224, and a signal focusing assembly 230.

In one embodiment, the acoustic pinger control module 224 is a data processing device, such as a general purpose or application specific processor, configured to control the operations of the acoustic pinger 210. In particular, the acoustic pinger control module 224 is configured to communicate with the system control module 116 (FIG. 1), with the acoustic source 220, and with the acoustic sensor 222.

The acoustic source 220 is a transducer device configured to convert an electrical signal into an acoustic signal in response to a received command. In an embodiment, the acoustic source 220 generates the acoustic signal at a defined frequency, such as a subsonic or ultrasonic signal. In another embodiment, the acoustic source 220 can select the frequency of the generated acoustic signal from a range of available frequencies, where the selected signal is based on the received command.

The acoustic sensor 222 is a transducer device configured to convert a received acoustic signal into an electrical signal. In an embodiment, an energy level of the electrical signal is proportional to the energy level of the received acoustic signal. In an embodiment, the acoustic sensor 222 converts only acoustic signals within a defined frequency range.

The signal focusing assembly 230 is an assembly configured to directionally focus both acoustic signals generated by and acoustic signals received at the acoustic pinger 210. For example, in the illustrated embodiment the signal focusing assembly 230 is of a generally conical shape that focuses a generated acoustic signal so that the signal is stronger along the axis of the cone. Further, the signal focusing assembly 230 dampens received signals that are not along the axis of the cone. Accordingly, the signal focusing assembly provides for greater control of the directionality of both generated and received acoustic signals.

In operation, the acoustic pinger control module 224 receives instructions from the system control module to sense the position of the manhole cover 102. In response, the acoustic pinger control module 224 sends a signal to the acoustic source 220 to generate an acoustic signal. The acoustic signal is focused by the signal focusing assembly 230 in the general direction of the manhole cover 102. In addition, a defined amount of time after an acoustic signal is generated by the acoustic source 220, one or more samples are taken at the acoustic sensor 222. The samples indicate a detected acoustic energy level at the sensor. Accordingly, the greater the energy level, the more likely that the generated acoustic signal has been reflected back to the acoustic sensor 222 by the manhole cover 102. The acoustic pinger control 224 compares the acoustic energy level indicated by the one or more samples and compares the energy level to a threshold. The threshold is set to be indicative of the presence of the manhole cover 102 in an expected position. Thus, if the acoustic energy level is below the threshold, the acoustic pinger control module 224 determines that the manhole cover 102 has been moved from the expected position, and provides an indication to the system control module 116.

Figure 3:
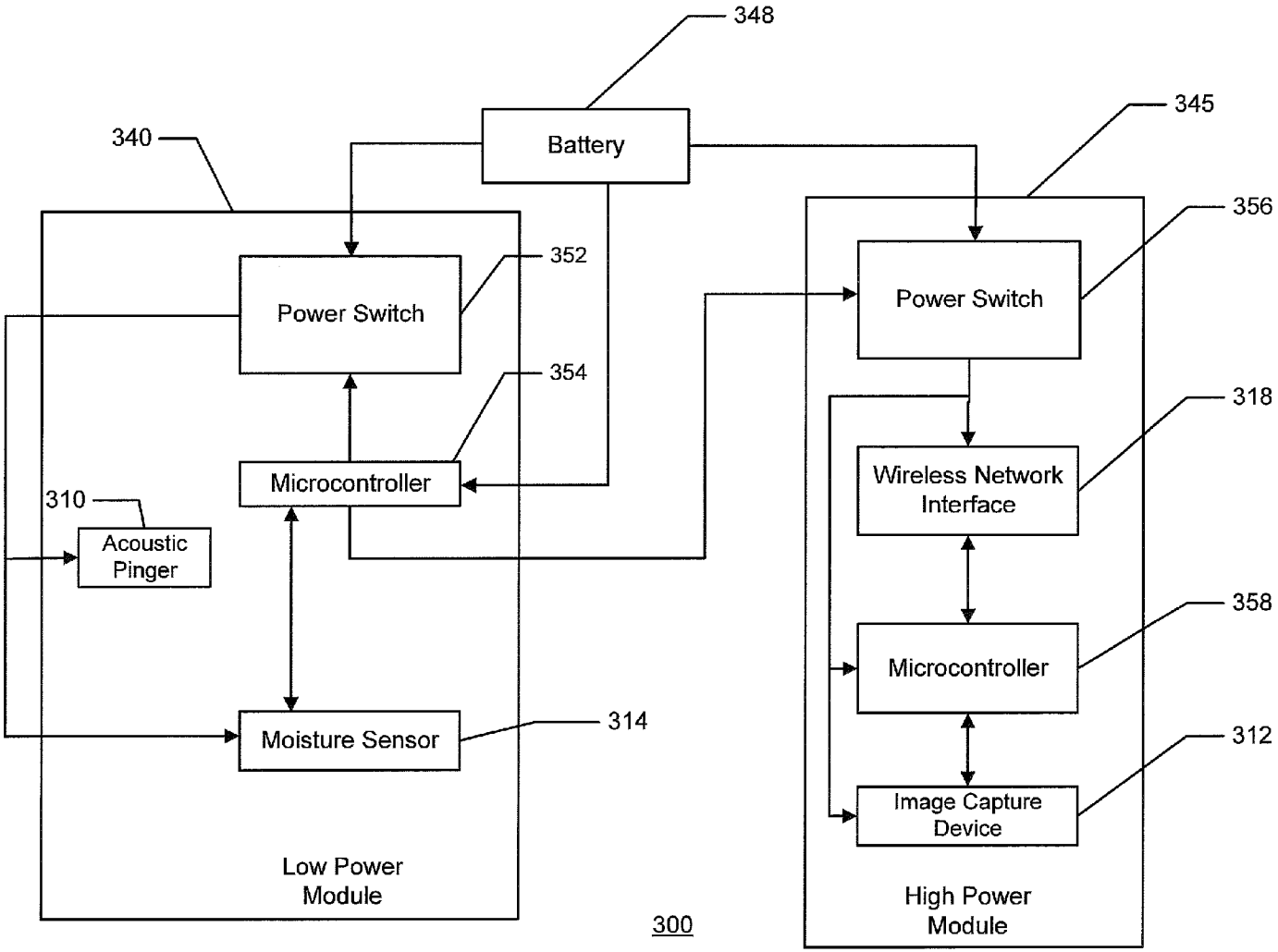
FIG. 3 is a block diagram of the manhole security device in accordance with another embodiment of the present disclosure.

FIG. 3 illustrates a particular embodiment of a manhole security device 300, corresponding to the manhole security device 100 of FIG. 1. The manhole security device 300 includes a battery 348, a low power module 340, and a high power module 345. The low power module 340 and high power module 345 represent power domains of the manhole security device 300, and do not necessarily represent different physical modules. For example, the modules included in the low power module 340 and high power module 345 can be enclosed in a common physical housing. Thus, the illustrated power modules are indicative of different power levels provided to the components of each module. Further, it will be appreciated that the high power module 345 is provided a relatively higher amount of power than the low power module 340, but that the terms "high power" and "low power" do not represent absolute power levels or ranges.

In the illustrated embodiment, the low power module 340 includes a power switch 352, a microcontroller 354, an acoustic pinger 310, and a moisture sensor 314. The high power module 345 includes a power switch 356, a wireless network interface 318, a microcontroller 358, and an image capture device 312. The power switches 352 and 356 each include an input connected to the battery 348. The power switch 352 includes an output connected to the acoustic pinger 310 and to the moisture sensor 314. The power switch 356 includes an output connected to the wireless network interface 318, the microcontroller 358, and the image capture device 312. The microcontroller 354 includes an input connected to the battery 348, an input/output port connected to the acoustic pinger 310, an input/output port connected to the moisture sensor 314, an output connected to the power switch 352, and an output connected to the power switch 356. The microcontroller 358 includes an input/output port connected to the wireless network interface 318 and an input/output port connected to the image capture device 312.

The illustrated modules of the manhole security device 300 perform functions corresponding to the similarly numbered items of FIG. 1. Thus, for example, the image capture device 312 is a device configured to capture an image in response to a command from the microcontroller 358. The microcontroller 358 and microcontroller 354 are configured to each perform a portion of the functions of the system control module 116, as described further herein. In addition, the microcontroller 354 is configured to control a power cycle of the manhole security device 300.

To illustrate, during operation, the manhole security device 300 is configured to operate in a minimum power mode, a low power mode, and a high power mode. In the minimum power mode, the power switches 352 and 356 are configured so that little or no power is provided to the acoustic pinger 310, the moisture sensor 314, the wireless network 318, the microcontroller 358, and the image capture device 312, such that each of these modules is not operational. Further, in the minimum power mode, the battery 348 provides power to the microcontroller 354, which monitors a clock signal (not shown). In response to determining completion of a duty cycle of the clock signal, the microcontroller 348 controls power switch 352 so that power is provided to the acoustic pinger 310 and to the moisture sensor 314. The microcontroller 354 determines, based on information provided by the moisture sensor 314, whether the level of moisture surrounding the manhole security device 300 is such that the device can reliably detect the position of the manhole cover 102 (FIG. 1). If so, the microcontroller 348 instructs the acoustic pinger 310 to determine the position of the manhole cover 102, as described above with respect to FIGS. 1 and 2. If the acoustic pinger 310 indicates that the manhole cover is in the expected position, the microcontroller 348 controls the power switch 352 so that power is decoupled from the acoustic pinger 310 and from the moisture controller 314. The microcontroller 348 then repeats the above at the conclusion of each duty cycle of the clock signal. Thus, microcontroller 348 periodically "wakes up" the acoustic pinger 310 to an active state to determine the position of the manhole cover 102, and returns the acoustic pinger 310 and moisture sensor 314 to inactive states between active periods. This conserves power and extends the useful lifetime of the battery 348.

If, during an active period, the acoustic pinger 310 indicates the manhole cover 102 has been moved from its expected position, the microcontroller 354 controls the power switch 356 so that power is provided to the wireless network interface 318, the microcontroller 358, and the image capture device 312. In response, each of these modules is awakened and placed in an active state. In response to entering the active state, the microcontroller 358 instructs the image capture device 312 to capture one or more images, as described above with respect to FIG. 1. In addition, the microcontroller 358 can provide an indication, via wireless network interface 318, that the manhole cover 102 has been moved from its expected position. After capturing images and providing the indication, the modules of the high power module 345 can return to the minimum power mode. Thus, the modules of the high power module 345 are activated only if the acoustic pinger 310 indicates that the manhole cover 102 has been moved from its expected position, and otherwise remain in inactive states where they consume a relatively small amount of power. The useful lifetime of the battery 348 is thus extended.

Figure 4:
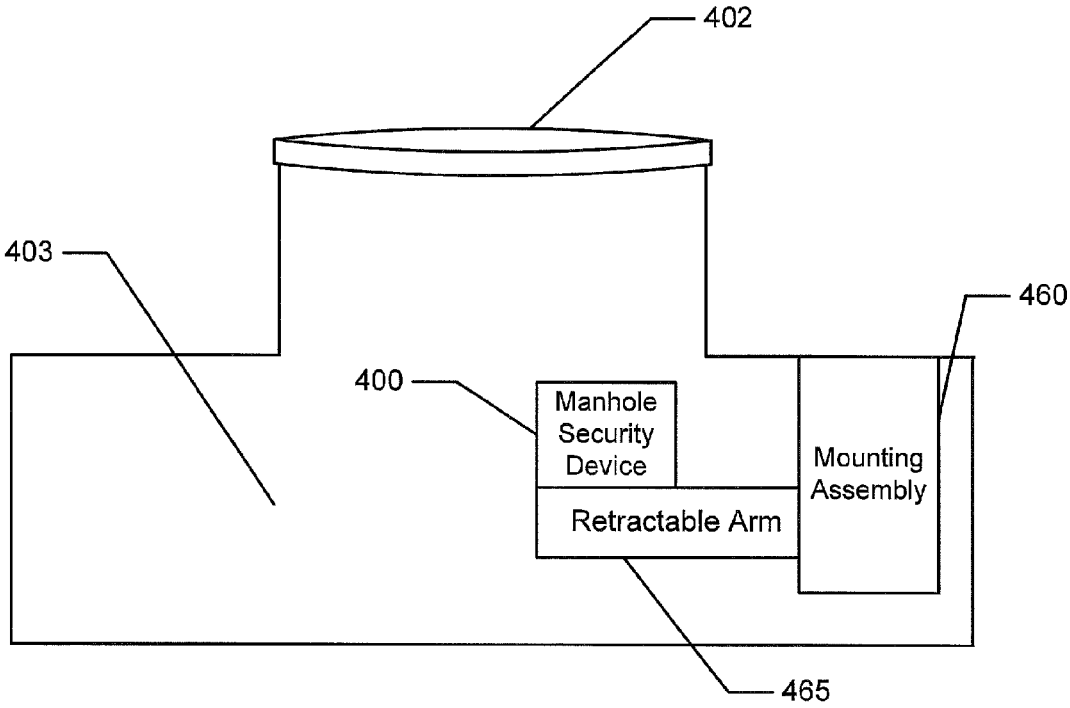
FIG. 4 is a block diagram of a device mounting system for the manhole security device of FIG. 1 in accordance with one embodiment of the present disclosure.

FIG. 4 illustrates a block diagram of a particular embodiment of a mounting system for a manhole security device 400. The operation of the manhole security device 400 corresponds to the operation of the manhole security device 100 of FIG. 1. In the illustrated embodiment, the manhole security device 400 is attached to a retractable arm 465, which itself is attached to a mounting assembly 460. The mounting assembly is mounted to an upper wall or ceiling of the enclosure 403, thereby raising the manhole security device 400 and reducing the impact of rain or other moisture collecting on the floor of the enclosure.

In operation, the retractable arm 465 can include a locking mechanism that locks the manhole security device 400 in place such that it detects whether manhole cover 402 is in an expected position, as described above with respect to FIGS. 1-3. The locking assembly can be unlocked with a key, such that the retractable arm 465 can be partially moved in a lateral direction toward the mounting assembly 460. The lateral movement results in a commensurate movement of the manhole security device 400, so that the device does not block access to the enclosure 403. Thus, authorized personnel, can more easily access electrical cabling or other infrastructure located within enclosure 403.

Figure 5:
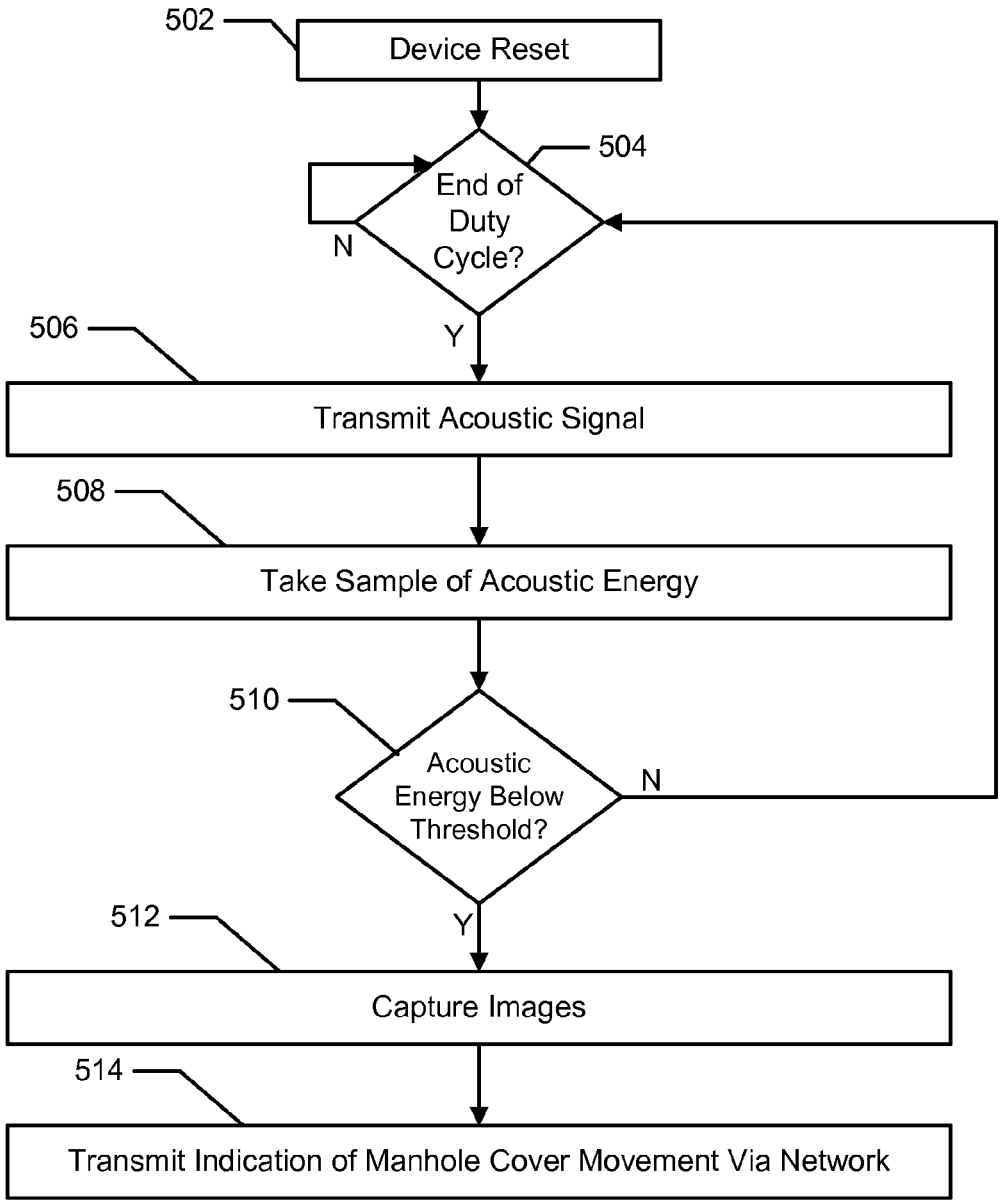
FIG. 5 is a flow diagram of a method of determining the position of a manhole cover in accordance with one embodiment of the present disclosure.

FIG. 5 illustrates a flow diagram of a method of detecting the position of a manhole cover in accordance with one embodiment of the present disclosure. At block 502, a manhole security device is reset, such as by a reset signal or by powering on the device. At block 504, the manhole security device determines whether a duty cycle of a clock signal has ended. If not, the method flow remains at block 504 until the duty cycle has ended. In response to the end of the duty cycle, the method flow proceeds to block 506 and the manhole security device transmits an acoustic signal in the direction of a manhole cover. At block 508, the manhole security device takes a sample of acoustic energy to determine whether the manhole cover has reflected the acoustic signal. At block 510, the manhole security device determines whether the acoustic energy of the sample is below a threshold, thus indicating that the manhole cover has been moved from an expected position. If not, the method returns to block 504 and the manhole security device 504 awaits the end of another duty cycle.

If the acoustic energy is below the threshold, indicating the manhole cover has been moved, the method flow proceeds to block 512 and the manhole security device captures one or more images of an area around the expected position of the manhole cover. The manhole security device thereby captures an image of any individuals that have moved the manhole cover from its expected position. The method flow moves to block 514, and the manhole security device transmits an indication that the manhole cover has been moved to a remote security station via a network. Security officers at the remote security station can then take appropriate action, such as notification of local authorities, retrieval of the captured images, or the like.

The illustrations of the embodiments described herein are intended to provide a general understanding of the structure of the various embodiments. The illustrations are not intended to serve as a complete description of all of the elements and features of apparatus and systems that utilize the structures or methods described herein. Many other embodiments may be apparent to those of skill in the art upon reviewing the disclosure. Other embodiments may be utilized and derived from the disclosure, such that structural and logical substitutions and changes may be made without departing from the scope of the disclosure. Additionally, the illustrations are merely representational and may not be drawn to scale. Certain proportions within the illustrations may be exaggerated, while other proportions may be minimized. Accordingly, the disclosure and the FIGs. are to be regarded as illustrative rather than restrictive.

The Abstract of the Disclosure is provided to comply with 37 C.F.R. §1.72(b) and is submitted with the understanding that it will not be used to interpret or limit the scope or meaning of the claims. In addition, in the foregoing Detailed Description of the Drawings, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description of the Drawings, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosed subject matter. Thus, to the maximum extent allowed by law, the scope of the present disclosed subject matter is to be determined by the broadest permissible interpretation of the following claims and their equivalents, and shall not be restricted or limited by the foregoing detailed description.

What is claimed is:

1. A method, comprising:

determining, at a first data processing device, a first position of a manhole cover; and in response to determining that the manhole cover is moved to a second position, automatically capturing an image of an area around the second position.

2. The method of claim 1 wherein determining the second position of the manhole cover comprises:

applying an acoustic signal to the first position; and determining an energy level at a sensor device in response to applying the acoustic signal, wherein the energy level indicates the second position of the manhole cover.

3. The method of claim 1 wherein determining the second position of the manhole cover comprises:

applying a light-based signal to the first position; and determining an energy level at a sensor device in response to applying the light-based signal, wherein the energy level indicates the second position of the manhole cover.

4. The method of claim 1 wherein determining the second position of the manhole cover comprises measuring changes in an electromagnetic field.

5. The method of claim 1 further comprising:

in response to determining that the manhole cover is moved to the second position, communicating an indication to a communications network.

6. The method of claim 5 wherein the indication specifies a geographic location of the second position.

7. The method of claim 1 wherein determining the first position of the manhole cover comprises periodically determining the first position of the manhole cover for a first period of time.

8. The method of claim 7 further comprising:

suspending determination of the first position of the manhole cover for a second period of time in response to determining that a moisture level near the image capture device is above a threshold level.

9. The method of claim 1 wherein the image is captured with an infra-red camera device.

10. The method of claim 1 wherein the image is captured with a device comprising a lens, the lens comprising a hydrophobic material.

11. A method, comprising:

determining an energy level at a sensor device;

in response to determining based on the energy level that a manhole cover has been moved from a position, automatically capturing an image of an area around the position.

12. The method of claim 11 further comprising:

in response to determining based on the energy level that the manhole cover has been moved from the position, providing an indication to a remote device via a network.

13. The method of claim 12 wherein providing the indication comprises providing the image to the remote device via the network.

14. The method of claim 11 wherein determining the energy level comprises determining an acoustic energy level.

15. A system, comprising:

a signal generation device configured to generate a signal;

a sensor device configured to sense an energy level in response to generation of the signal, the energy level based on a first position of a manhole cover;

an image capture device; and a processor configured to automatically instruct the image capture device to capture an image when the energy level indicates that the first position of the manhole cover is not a second position.

16. The system of claim 15 wherein the signal is an acoustic signal.

17. The system of claim 16 wherein the signal generation device comprises a focusing assembly configured to focus the signal in a first direction.

18. The system of claim 15 further comprising:

a mounting assembly to mount the system to a surface; and a retractable arm coupled to the image capture device and coupled to the mounting assembly, wherein the retractable arm may be moved in the direction of the mounting assembly.

19. The system of claim 15 further comprising a network interface configured to communicate with a network, the processor configured to communicate an indication to the network when the energy level indicates that the position of the manhole cover is not the second position.

20. The system of claim 15 wherein the image capture device is a camera.

* * * * *